US005124632A

United States Patent [19]

Greaves

[11] Patent Number: 5,124,632

[45] Date of Patent: Jun. 23, 1992

[54] LOW-VOLTAGE PRECISION CURRENT GENERATOR

[75] Inventor: Carlos A. Greaves, Austin, Tex.

[73] Assignee: Motorola, Inc., Schaumburg, Ill.

[21] Appl. No.: 724,281

[22] Filed: Jul. 1, 1991

[51] Int. Cl.[5] ..... G05F 3/24; G05F 3/28

[52] U.S. Cl. ..... 323/316; 323/314; 307/296.8; 330/288

[58] Field of Search ..... 323/313, 314, 315, 316; 307/296.1, 296.6, 296.8; 330/253, 257, 288

[56] References Cited

U.S. PATENT DOCUMENTS

| | | | |
|---|---|---|---|
| 4,629,913 | 12/1986 | Lechner | 323/316 |
| 4,697,154 | 9/1987 | Kousaka et al. | 330/288 |
| 4,700,144 | 10/1987 | Thomson | 330/257 |
| 4,931,676 | 6/1990 | Baiocchi et al. | 323/315 |
| 4,965,510 | 10/1990 | Kriedt et al. | 323/316 |
| 5,061,862 | 10/1991 | Tamagawa | 307/296.6 |

OTHER PUBLICATIONS

Gregorian, R. and Temes, G. C., Analog MOS Integrated Circuits for Signal Processors, John Wiley & Sons, New York, 1986, p. 450.

*Primary Examiner*—Peter S. Wong
*Attorney, Agent, or Firm*—Paul J. Polansky

[57] ABSTRACT

A low voltage precision current generator includes an amplifier, a first transistor, a current portion, and an output portion. The amplifier has first and second input terminals and changes an output voltage until voltages at the first and second input terminals are equal. An input voltage which may be a stable reference voltage or a variable voltage is received at the first input terminal. The second input terminal is connected to the current portion in order to provide a reference current proportional to a voltage difference between the voltage at the second input terminal and a power supply voltage. The amplifier controls the conductivity of the first transistor in order to regulate the voltage at its second input terminal. A precision current precision current proportional to the reference current is then provided.

16 Claims, 2 Drawing Sheets

40

20

-PRIOR ART-

30

-PRIOR ART-

40

60

LOW-VOLTAGE PRECISION CURRENT GENERATOR

FIELD OF THE INVENTION

This invention relates generally to analog circuits, and more particularly, to low-voltage precision current generators.

BACKGROUND OF THE INVENTION

Current generators (commonly referred to as current sources and current sinks) are important elements in the design of many electrical circuits. For example, current generators are used in differential amplifiers. Input voltages received at control electrodes of respective input transistors selectively divert the current provided by the current generator to change the output voltage of the amplifier. In many analog circuits, it is further necessary to provide a current whose magnitude is proportional to a reference voltage. For example, a voltage controlled oscillator often employs a voltage controlled current source. In commercial integrated circuits, it is desirable for the voltage-controlled current source to function under a variety of conditions, including variations in power supply voltage, temperature, and manufacturing process variations in which transistor thresholds vary. Some integrated circuits, once required to operate with a five-volt power supply voltage, must now function at a lower power supply voltage such as three volts. Thus, precision current generators are needed for low voltage operation.

SUMMARY OF THE INVENTION

Accordingly, there is provided, in one form, a low voltage precision current generator coupled to first and second power supply voltage terminals comprising an amplifier, a first transistor, a current portion, and an output portion. The amplifier provides a first voltage signal in response to a difference in voltage between first and second input signals respectively received at first and second input terminals thereof. The first transistor has a first current electrode, a control electrode for receiving the first voltage signal, and a second current electrode coupled to the second power supply voltage terminal. The current portion is coupled to the second input terminal of the amplifier and to the first current electrode of the first transistor, and provides a reference current proportional to a difference in voltage between the second input terminal of the amplifier and a predetermined voltage terminal. The output portion is coupled to the current portion and provides the precision current in response to the reference current.

These and other features and advantages will be more clearly understood from the following detailed description taken in conjunction with the accompanying drawings.

DETAILED DESCRIPTION OF THE INVENTION

Figure 1:
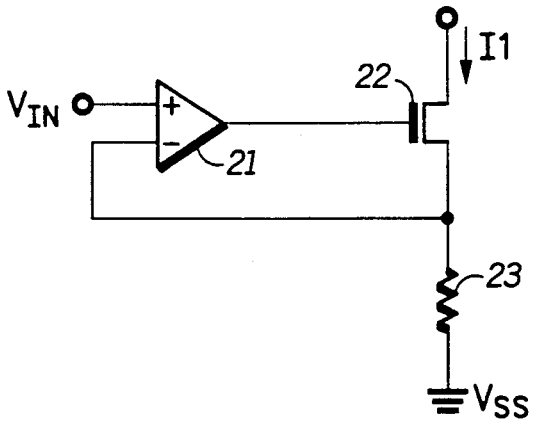
FIG. 1 illustrates in partial schematic and partial block form a voltage-controlled current generator circuit known in the prior art.

FIG. 1 illustrates in partial schematic and partial block from a voltage-controlled current generator circuit 20 known in the prior art. See Gregorian, R. and Temes, G. C., *Analog MOS Integrated Circuits for Signal Processors*, John Wiley & Sons, New York, 1986, p. 450. Circuit 20 includes an operational amplifier 21, an N-channel transistor 22, and a resistor 23. Operational amplifier 21 has a positive input terminal for receiving an input voltage labelled "$V_{IN}$", a negative input terminal, and an output terminal. Transistor 22 has a drain for receiving a current labelled "I1", a gate connected to the output terminal of operational amplifier 21, and a source connected to the negative input terminal of operational amplifier 21. Resistor 23 has a first terminal connected to the source of transistor 22 and to the negative input terminal of operational amplifier 21, and a second terminal connected to a power supply voltage terminal labelled "$V_{SS}$". $V_{SS}$ is a more-negative power supply voltage terminal typically at 0 volts. An additional, more-positive power supply voltage terminal labelled "$V_{DD}$" is not shown in FIG. 1.

Analysis of the operation of circuit 20 is straightforward. Operational amplifier 21 changes the voltage at its output terminal until the voltage at the negative input terminal equals the voltage at the positive input terminal. Thus, the voltage at the first terminal of resistor of resistor 23 is equal to $V_{IN}$. The current flowing through resistor 23, and thus through the drain-to-source path of transistor 22, is provided by $$I1 = V_{IN}/R_{IN} \quad (1)$$

where $R_{IN}$ is the resistance of resistor 23. Thus output current I1 is proportional to the input voltage $V_{IN}$.

Figure 2:
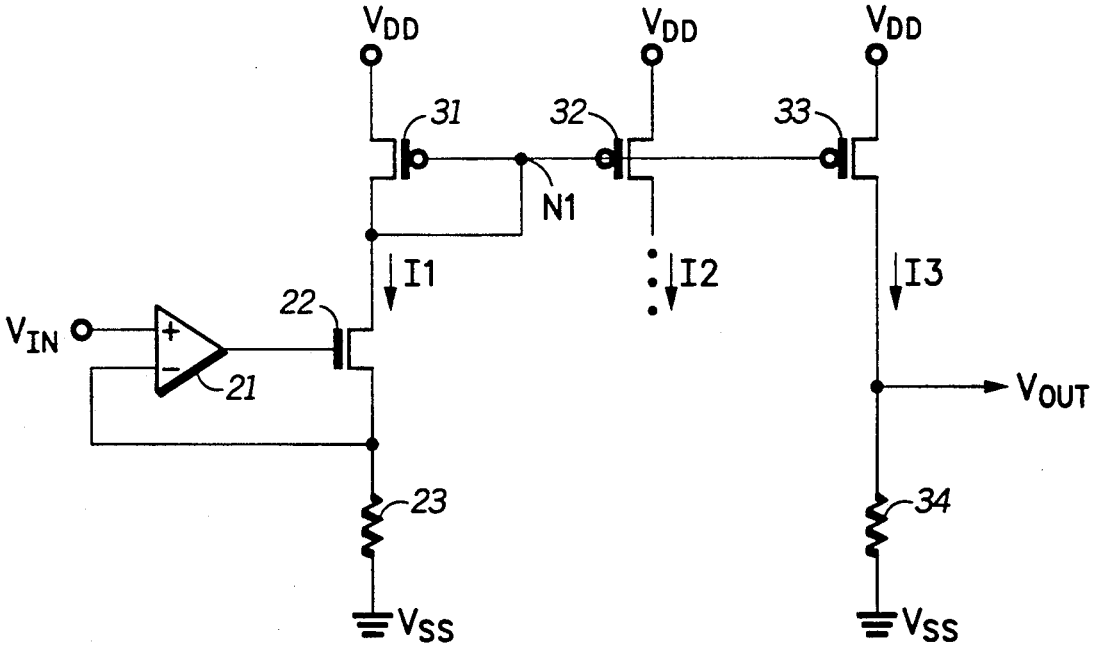
FIG. 2 illustrates in partial schematic and partial block form a voltage-controlled current generator circuit known in the prior art and adapted from the voltage-controlled current generator circuit of FIG. 1.

Circuit 20 of FIG. 1 forms a current sink, causing current I1 to flow from the drain of transistor 21 into the more-negative power supply voltage terminal $V_{SS}$. However, a modification of circuit 20 of FIG. 1 provides a voltage controlled current source. FIG. 2 illustrates in partial schematic and partial block form a voltage-controlled current generator circuit 30 known in the prior art and adapted from voltage-controlled current generator circuit 20 of FIG. 1. Circuit 30 has elements corresponding to operational amplifier 21, transistor 22, and resistor 23 and those elements are similarly numbered in FIG. 2. Circuit 30 additionally includes P-channel transistors 31–33, and resistor 34. Transistor 31 has a source connected to $V_{DD}$, a gate, and a drain connected to the gate of transistor 31 at a node labelled "N1", and to the drain of transistor 22. Transistor 32 has a source connected to $V_{DD}$, a gate connected to node N1, and a drain for providing a current labelled "I2". Transistor 33 has a source connected to $V_{DD}$, a gate connected to node N1, and a drain for providing a current labelled "I3" at a node providing a voltage labelled "$V_{OUT}$". Resistor 34 has a first terminal connected to the drain of transistor 33, and a second terminal connected to $V_{SS}$.

Circuit 30 illustrates the uses to which circuit 20 of FIG. 1 may be put. First, transistor 31 mirrors current I1 through transistor 32 to provide current I2 flowing from the drain electrode thereof to elements not shown in FIG. 2. Thus, circuit 30 functions as a current source. I1 is further mirrored through transistor 33 to provide a current I3. Resistor 34 converts the current flowing through transistor 33 and resistor 34 into voltage $V_{OUT}$. The magnitude of $V_{OUT}$ can also be easily determined. The current flowing through the drain-to-source path of transistor 22, I1, is mirrored through transistor 33. If the transistor gate sizes are equal, measured in the gate width-to-length (W/L) ratio, then I3=I1. If the resistance of resistor 34 is labelled "$R_{OUT}$", then $$V_{OUT}=I3*R_{OUT}=V_{IN}(R_{OUT}/R_{IN}) \quad (2)$$

Further, assume that the actual width-to-length ratio of transistor 31 is equal to $(W/L)_1$. If the actual width-to-length ratio of transistor 32 is equal to $X*(W/L)_1$, then $$I2=X*I1 \quad (3)$$

Thus, when a current mirror is used as shown in FIG. 2, a voltage-controlled current source is produced and the current provided by the current source may be modified.

However, circuit 30 has a problem at low power supply voltage. The headroom requirements of transistors 31 and 22 limit the operation of circuit 30 at low power supply voltages. Since operational amplifier 21 sets the voltage at the source of transistor 22 to be equal to $V_{IN}$, the drain-to-source voltage ($V_{DS}$) of transistor 31 plus the $V_{DS}$ of transistor 22 must equal ($V_{DD}-V_{IN}$). $V_{IN}$ is typically a bandgap reference voltage with a value of about 1.2 volts. Thus, at a desired power supply voltage of 3 volts, the sum of the $V_{DS}$ of transistors 31 and 22 must equal 1.8 volts. Transistor 31 is diode-connected; thus, its $V_{DS}$ equals its gate-to-source voltage ($V_{GS}$). In order to keep current I1 flowing, the $V_{GS}$, and hence the $V_{DS}$ of transistor 31 must remain constant. As $V_{DD}$ drops, the $V_{DS}$ of transistor 31 is still maintained. At the same time, the voltage at the drain of transistor 22 drops while the voltage at the source of transistor 22 remains constant. Thus, as $V_{DD}$ drops, the $V_{DS}$ of transistor 22 drops, eventually taking transistor 22 out of saturation. As soon as transistor 22 comes out of saturation, the precision current reference is lost. For practical purposes, and for typical reference currents, circuit 30 is limited in operation to a value of $V_{DD}$ of about 4 volts or greater.

Figure 3:
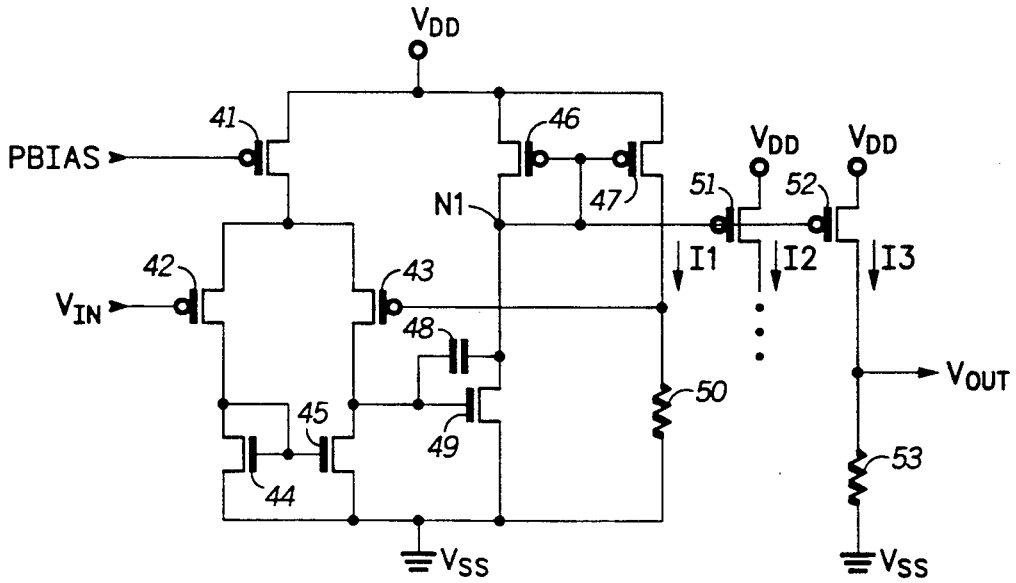
FIG. 3 illustrates in schematic form a low-voltage precision current generator circuit in accordance with the present invention.

FIG. 3 illustrates in schematic form a low-voltage precision current generator circuit 40 in accordance with the present invention. Circuit 40 includes P-channel transistors 41–43, N-channel transistors 44 and 45, P-channel transistors 46 and 47, a capacitor 48, an N-channel transistor 49, a resistor 50, P-channel transistors 51 and 52, and a resistor 53. For circuit 40, $V_{DD}$ provides a first power supply voltage terminal and $V_{SS}$ provides a second power supply voltage terminal. Transistor 41 has a source connected to $V_{DD}$, a gate for receiving a reference voltage labelled "PBIAS", and a drain. Transistor 42 has a source connected to the drain of transistor 42, a gate for receiving reference voltage $V_{IN}$, and a drain. In the illustrated embodiment $V_{IN}$ is a bandgap reference voltage equal to approximately 1.2 volts; however, in other embodiments, $V_{IN}$ can be a variable voltage. Transistor 43 has a source connected to the drain of transistor 41, a gate, and a drain. Transistor 44 has a drain connected to the drain of transistor 42, a gate connected to the drain of transistor 42, and a source connected to $V_{SS}$. Transistor 45 has a drain connected to the drain of transistor 43, a gate connected to the drain of transistor 42, and a source connected to $V_{SS}$. Transistor 46 has a source connected to $V_{DD}$, a gate, and a drain connected to the gate of transistor 46. Transistor 47 has a source connected to $V_{DD}$, a gate connected to the drain of transistor 46, and a drain connected to the gate of transistor 43 and also providing current I1. Capacitor 48 has a first terminal connected to the drain of transistor 43, and a second terminal connected to the drain of transistor 46. Transistor 49 has a drain connected to the drain of transistor 46, a gate connected to the drain of transistor 43, and a source connected to $V_{SS}$. Resistor 50 has a first terminal connected to the drain of transistor 47, and a second terminal connected to $V_{SS}$. Transistor 51 has a source connected to $V_{DD}$, a gate connected to the drain of transistor 46, and a drain for providing current I2. Transistor 52 has a source connected to $V_{DD}$, a gate connected to the drain of transistor 46, and a drain for providing current I3 to the node providing $V_{OUT}$. Resistor 53 has a first terminal connected to the drain of transistor 52, and a second terminal connected to $V_{SS}$.

The general operation of circuit 40 is easily analyzed. Transistors 41–45 function as an differential amplifier, with the gate of transistor 42 functioning as the positive input terminal, the gate of transistor 43 functioning as the negative input terminal, and the drain of transistor 43 functioning as the output terminal. Transistor 46 will source whatever current is required to make transistor 47 mirror a current determined as $$I1=V_{IN}/R_{IN} \quad (4)$$

where $R_{IN}$ is the resistance of resistor 50. If transistors 46 and 47 have the same W/L ratios, then the currents conducted through transistors 46 and 47 will be the same and equal to I1. Thus, the voltage at the drain of transistor 43 changes until the voltage at the gate of transistor 43 is equal to $V_{IN}$. The voltage at the first terminal of resistor 50 is set to $V_{IN}$, and current I1 (similarly labelled as in FIGS. 1 and 2) flows through resistor 50. The current I1 provided by circuit 40 is identical to current I1 provided by circuit 30, as illustrated by comparing equation (4) to equation (1). In order for I1 to flow through resistor 50, I1 must flow through the drain-to-source paths of transistors 46 and 47 in order to be mirrored by transistor 46 through transistor 47. Thus, the voltage at node N1 is set to bias a transistor of a given W/L ratio to conduct current I1. As before, transistor 51 may have a different W/L ratio which is a multiple or fraction of the W/L ratio of transistor 46 such that a different current I2 is provided to circuitry not shown in FIG. 3. Furthermore, transistor 52 may have the same W/L ratio as transistor 46 to provide I3=I1 from the drain of transistor 52. Resistor 53 converts I3 into voltage $V_{OUT}$ as follows:

$$V_{OUT}=I3*R_{OUT}=V_{IN}(R_{OUT}/R_{IN}) \quad (5)$$

where $R_{OUT}$ is equal to the resistance of resistor 53. Thus, circuit 40 performs an identical operation as circuit 30 of FIG. 2, as illustrated by comparing equation (5) to equation (2).

At the same time, circuit 40 solves the headroom problem associated with circuit 30 of FIG. 2 to guarantee operation at substantially lower power supply voltage, in the illustrated embodiment of $V_{DD}$ below 3 volts. As $V_{DD}$ drops, the available headroom is $(V_{DD}-V_{IN})$, which is equal to about 1.8 volts. However, only a single transistor, transistor 47, must remain in saturation within the bounds of this headroom. Under typical MOS geometries, 1.8 volts is substantially greater than the $V_{DS}$ of P-channel MOS transistor 47 which occurs when transistor 46 is conducting current I1. Thus, transistor 47 remains saturated at power supply voltages of 3.0 volts and below. Capacitor 48 is included to provide dominant pole compensation. As the number of transistors to which node N1 is connected increases, the capacitance at the drain of transistor 46 increases. Capacitor 48 is included to ensure that the drain of transistor 43 remains the dominant pole. Thus, stability is ensured.

Figure 4:
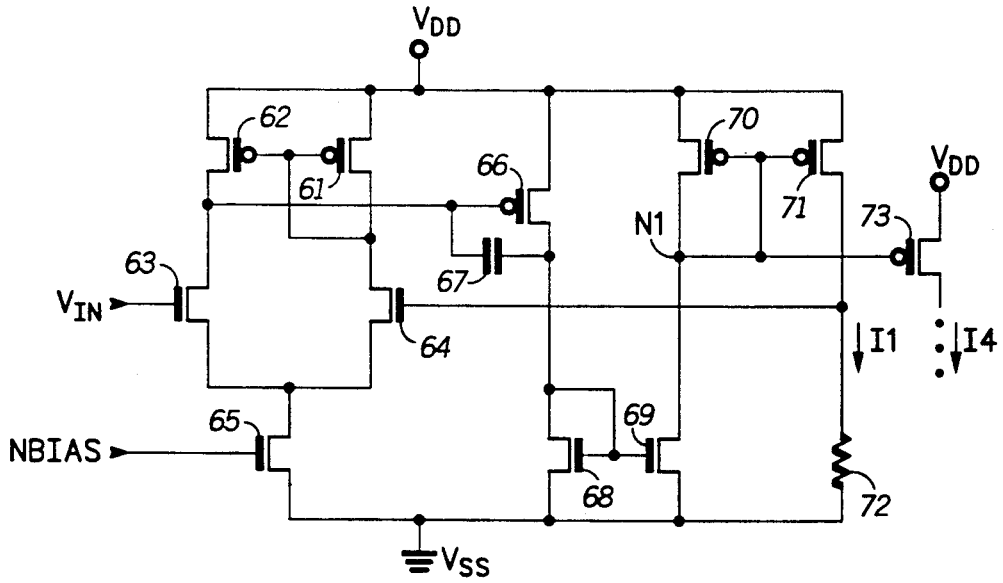
FIG. 4 illustrates in schematic form an alternate embodiment of the low-voltage precision current generator circuit of FIG. 3 in accordance with the present invention.

FIG. 4 illustrates in schematic form an alternate embodiment 60 of low-voltage precision current generator circuit 40 of FIG. 3 in accordance with the present invention. It should be apparent however that circuit 60 is not a complete mirror image of circuit 40 for the reasons set forth in more detail below. Circuit 60 includes P-channel transistors 61 and 62, N-channel transistors 63-65, a P-channel transistor 66, a capacitor 67, N-channel transistors 68 and 69, P-channel transistors 70 and 71, a resistor 72, and a P-channel transistor 73. For circuit 60, $V_{SS}$ provides a first power supply voltage terminal and $V_{DD}$ provides a second power supply voltage terminal. Transistor 61 has a source connected to $V_{DD}$, a gate, and a drain connected to the gate of transistor 61. Transistor 62 has a source connected to $V_{DD}$, a gate connected to the drain of transistor 61, and a drain. Transistor 63 has a drain connected to the drain of transistor 62, a gate for receiving signal $V_{IN}$, and a source. Transistor 64 has a drain connected to the drain of transistor 61, a gate, and a source connected to the source of transistor 63. Transistor 65 has a drain connected to the drains of transistors 63 and 64, a gate for receiving a bias signal labelled "NBIAS", and a source connected to $V_{SS}$. NBIAS is a voltage which biases transistor 65 to act as a current source. Transistor 66 has a source connected to $V_{DD}$, a gate connected to the source of transistor 62, and a drain. Capacitor 67 has a first terminal connected to the drain of transistor 62, and a second terminal connected to the drain of transistor 66. Transistor 68 has a drain connected to the drain of transistor 66, a gate connected to the drain of transistor 68, and a source connected to $V_{SS}$. Transistor 69 has a drain, a gate connected to the drain of transistor 66, and a source connected to $V_{SS}$. Transistor 70 has a source connected to $V_{DD}$, a gate, and a drain connected to the gate of transistor 70 and to the drain of transistor 69 at node N1. Transistor 71 has a source connected to $V_{DD}$, a gate connected to the drain of transistor 70, and a drain providing current I1. Resistor 72 has a first terminal connected to the drain of transistor 71 and the gate of transistor 64, and a second terminal connected to $V_{SS}$. Transistor 73 has a source connected to $V_{DD}$, a gate connected to the drain of transistor 70, and a source for providing a current labelled "I4" provided to circuitry not shown in FIG. 4.

Circuit 60 functions as the complementary analog of circuit 40 of FIG. 3. It should be recognized that first power supply voltage terminal $V_{DD}$ in circuit 40 corresponds to first power supply voltage terminal $V_{SS}$ in complementary circuit 60, and second power supply voltage terminal $V_{SS}$ in circuit 40 corresponds to second power supply voltage terminal $V_{DD}$ in complementary circuit 60. While it should be readily apparent that circuit 60 has the same advantages as circuit 40 of FIG. 3, an important difference should be noted. While the drain of transistor 49 is connected directly to a current portion formed by transistors 46 and 47 and resistor 50 in circuit 40, the drain of analogous transistor 66 is coupled through a current mirror formed by transistors 68 and 69 to a current portion formed by transistors 70 and 71 and resistor 72 in circuit 60. Also the current mirror in circuits 40 and 60 are similarly formed, with transistor 46 corresponding to transistor 70, transistor 47 to transistor 71, and resistor 50 to resistor 72.

While the invention has been described in the context of a preferred embodiment, it will be apparent to those skilled in the art that the present invention may be modified in numerous ways and may assume many embodiments other than that specifically set out and described above. For example, the same current mirroring technique applied to circuit 60 of FIG. 4 could be applied to circuit 40 of FIG. 3 to provide a voltage-controlled current sink. Circuit 60 could provide a current sink by applying the voltage at the drain of transistor 68 to the gate of an N-channel transistor. In addition, the second terminal of resistor 50 in circuit 40 or resistor 72 in circuit 60 could be coupled to another fixed voltage terminal to still provide a precision reference current. Thus, the present invention encompasses different transistor conductivity types. Accordingly, it is intended by the appended claims to cover all modifications of the invention which fall within the true spirit and scope of the invention.

I claim:

1. A low voltage precision current generator coupled to first and second power supply voltage terminals, comprising:

amplifier means for providing a first voltage signal in response to a difference in voltage between first and second input signals respectively received at first and second input terminals thereof;

a first transistor having a first current electrode, a control electrode for receiving said first voltage signal, and a second current electrode coupled to the second power supply voltage terminal;

current means coupled to said second input terminal of said amplifier means and to said first current electrode of said first transistor, for providing a reference current proportional to a difference in voltage between said second input terminal of said amplifier means and a predetermined voltage terminal; and output means coupled to said current means for providing the precision current in response to said reference current.

2. The low voltage precision current generator of claim 1 wherein said current means comprises:

a second transistor having a first current electrode coupled to the first power supply voltage terminal, a control electrode coupled to said first current electrode of said first transistor, and a second current electrode coupled to said first current electrode of said first transistor;

a third transistor having a first current electrode coupled to said first power supply voltage terminal, a control electrode coupled to said first current electrode of said first transistor, and a second current electrode coupled to said second input terminal of said amplifier means and providing said reference current; and a resistor having a first terminal coupled to said second current electrode of said third transistor, and a second terminal coupled to said second power supply voltage terminal.

3. The low voltage precision current generator of claim 2 wherein said amplifier means comprises:

a fourth transistor having a first current electrode coupled to the first power supply voltage terminal, a control electrode for receiving a bias signal, and a second current electrode;

a fifth transistor having a first current electrode coupled to said second current electrode of said fourth transistor, a control electrode for providing said first input terminal of said amplifier means, and a second current electrode;

a sixth transistor having a first current electrode coupled to said second current electrode of said fifth transistor, a control electrode coupled to said second current electrode of said fifth transistor, and a second current electrode coupled to the second power supply voltage terminal;

a seventh transistor having a first current electrode coupled to said second current electrode of said fourth transistor, a control electrode for providing said second input terminal of said amplifier means, and a second current electrode; and an eighth transistor having a first current electrode coupled to said second current electrode of said seventh transistor, a control electrode coupled to said second current electrode of said fifth transistor, and a second current electrode coupled to the second power supply voltage terminal.

4. The low voltage precision current generator of claim 3 further comprising a capacitor having a first terminal connected to said second current electrode of said seventh transistor, and a second terminal coupled to said first current electrode of said first transistor.

5. The low voltage precision current generator of claim 1 wherein said current means is coupled to said first current electrode of said first transistor through a current mirror.

6. The low voltage precision current generator of claim 5 wherein said current mirror comprises:

a second transistor having a first current electrode coupled to the first power supply voltage terminal, a control electrode coupled to said first current electrode of said first transistor, and a second current electrode coupled to said first current electrode of said first transistor; and a third transistor having a first current electrode coupled to said to first power supply voltage terminal, a control electrode coupled to said first current electrode of said first transistor, and a second current electrode coupled to said current means.

7. The low voltage precision current generator of claim 6 wherein said current means comprises:

a fourth transistor having a first current electrode coupled to said second current electrode of said third transistor, a control electrode coupled to said second current electrode of said third transistor, and a second current electrode coupled tp the second power supply voltage terminal;

a fifth transistor having a first current electrode coupled to said second input terminal of said amplifier means and providing said reference current, a control electrode coupled to said second current electrode of said third transistor, and a second current electrode coupled to the second power supply voltage terminal; and a resistor having a first terminal coupled to the first power supply voltage terminal, and a second terminal coupled to said first current electrode of said fifth transistor.

8. The low voltage precision current generator of claim 7 wherein said amplifier means comprises:

a sixth transistor having a first current electrode coupled to the first power supply voltage terminal, a control electrode for receiving a bias signal, and a second current electrode;

a seventh transistor having a first current electrode coupled to said second current electrode of said sixth transistor, a control electrode for providing said first input terminal of said amplifier means, and a second current electrode of providing said first voltage signal;

an eighth transistor having a first current electrode coupled to said second current electrode of said seventh transistor, a control electrode, and a second current electrode coupled to the second power supply voltage terminal;

a ninth transistor having a first current electrode coupled to said second current electrode of said sixth transistor, a control electrode for providing said second input terminal of said amplifier means, and a second current electrode; and a tenth transistor having a first current electrode coupled to said second current electrode of said ninth transistor, a control electrode coupled to said second current electrode of said ninth transistor and to said control electrode of said eighth transistor, and a second current electrode coupled to the second power supply voltage terminal.

9. The low voltage precision current generator of claim 8 further comprising a capacitor having a first terminal connected to said second current electrode of said seventh transistor, and a second terminal coupled to said first current electrode of said first transistor.

10. A low voltage precision current generator comprising:

amplifier means for providing a first voltage signal in response to a difference in voltage between first and second input signals respectively received at first and second input terminals thereof;

a first transistor having a first current electrode coupled to a first power supply voltage terminal, a control electrode, and a second current electrode coupled to said control electrode of said first transistor and providing an second voltage signal thereon;

a second transistor having a first current electrode coupled to said second current electrode of said first transistor, a control electrode for receiving said first voltage signal, and a second current electrode coupled to a second power supply voltage terminal;

a third transistor having a first current electrode coupled to said first power supply voltage terminal, a control electrode coupled to said second current electrode of said first transistor, and a second current electrode coupled to said second input terminal of said amplifier means; and a resistor having a first terminal coupled to said second terminal of said third transistor, and a second terminal coupled to said second power supply voltage terminal.

11. The low voltage precision current generator of claim 10 further comprising a fourth transistor having a first current electrode coupled to said first power supply voltage terminal, a control electrode for receiving said second voltage signal, and a second current electrode for providing the precision current.

12. The low voltage precision current generator of claim 10 further comprising a capacitor having a first terminal coupled to said control electrode of said second transistor, and a second terminal coupled to said second current electrode of said first transistor.

13. The low voltage precision current generator of claim 10 wherein said amplifier means comprises:

a fourth transistor having a first current electrode coupled to said first power supply voltage terminal, a control electrode for receiving a bias signal, and a second current electrode;

a fifth transistor having a first current electrode coupled to said second current electrode of said fourth transistor, a control electrode for providing said first input terminal of said amplifier means, and a second current electrode;

a sixth transistor having a first current electrode coupled to said second current electrode of said fifth transistor, a control electrode coupled to said second current electrode of said fifth transistor, and a second current electrode coupled to said second power supply voltage terminal;

a seventh transistor having a first current electrode coupled to said second current electrode of said fourth transistor, a control electrode for providing said second input terminal of said amplifier means, and a second current electrode for providing said first voltage signal; and an eighth transistor having a first current electrode coupled to said second current electrode of said seventh transistor, a control electrode coupled to said second current electrode of said fifth transistor, and a second current electrode coupled to said second power supply voltage terminal.

14. A low voltage precision current generator comprising:

a first transistor having a first current electrode coupled to a first power supply voltage terminal, a control electrode for receiving a bias signal, and a second current electrode;

a second transistor having a first current electrode coupled to said second current electrode of said first transistor, a control electrode for receiving a first input signal, and a second current electrode;

a third transistor having a first current electrode coupled to said second current electrode of said second transistor, a control electrode coupled to said second current electrode of said second transistor, and a second current electrode coupled to a second power supply voltage terminal;

a fourth transistor having a first current electrode coupled to said second current electrode of said first transistor, a control electrode, and a second current electrode;

an fifth transistor having a first current electrode coupled to said second current electrode of said fourth transistor, a control electrode coupled to said second current electrode of said second transistor, and a second current electrode coupled to said second power supply voltage terminal;

a sixth transistor having a first current electrode coupled to said first power supply voltage terminal, a control electrode, and a second current electrode coupled to said control electrode of said sixth transistor and providing an output voltage signal thereon;

a seventh transistor having a first current electrode coupled to said second current electrode of said sixth transistor, a control electrode coupled to said second current electrode of said fourth transistor, and a second current electrode coupled to said second power supply voltage terminal.

an eighth transistor having a first current electrode coupled to said first power supply voltage terminal, a control electrode coupled to said second current electrode of said sixth transistor, and a second current electrode coupled to said control electrode of said fourth transistor; and a resistor having a first terminal coupled to said second terminal of said eighth transistor, and a second terminal coupled to said second power supply voltage terminal.

15. The low voltage precision current generator of claim 14 further comprising a ninth transistor having a first current electrode coupled to said first power supply voltage terminal, a control electrode for receiving said second voltage signal, and a second current electrode for providing the precision current.

16. The low voltage precision current generator of claim 14 further comprising a capacitor having a first terminal coupled to said second current electrode of said fourth transistor, and a second terminal coupled to said second current electrode of said sixth transistor.

* * * * *

UNITED STATES PATENT AND TRADEMARK OFFICE

CERTIFICATE OF CORRECTION

PATENT NO. : 5,124,632

DATED : June 23, 1992

INVENTOR(S) : Carlos A. Greaves

It is certified that error appears in the above-identified patent and that said Letters Patent is hereby corrected as shown below:

Column 7, line 63, change "tp", to --to--.
Column 8, line 18, change "of", to --for--.
Column 10, line 30, change ".", to --;--.

Signed and Sealed this

Twenty-eighth Day of September, 1993

Bruce Lehman

*Attest:*

BRUCE LEHMAN

*Attesting Officer*

*Commissioner of Patents and Trademarks*